US009046224B2

(12) United States Patent
Yan et al.

(10) Patent No.: US 9,046,224 B2
(45) Date of Patent: Jun. 2, 2015

(54) LED LAMP WITH CONTROLLED DISTRIBUTION

(71) Applicant: Technical Consumer Products, Inc., Aurora, OH (US)

(72) Inventors: Ellis Yan, Aurora, OH (US); Timothy Chen, Aurora, OH (US)

(73) Assignee: Technical Consumer Products, Inc., Aurora, OH (US)

( * ) Notice: Subject to any disclaimer, the term of this patent is extended or adjusted under 35 U.S.C. 154(b) by 108 days.

(21) Appl. No.: 13/889,027

(22) Filed: May 7, 2013

(65) Prior Publication Data

US 2014/0334158 A1 Nov. 13, 2014

(51) Int. Cl.

*F21V 29/00* (2006.01)
*F21K 99/00* (2010.01)
*F21Y 101/02* (2006.01)

(52) U.S. Cl.

CPC ..... *F21K 9/50* (2013.01); *F21Y 2101/02* (2013.01); *F21K 9/135* (2013.01); *F21V 29/70* (2015.01)

(58) Field of Classification Search

CPC ..... F21Y 2101/02; F21K 9/00
USPC ..... 362/247, 249.02, 294, 235
See application file for complete search history.

(56) References Cited

U.S. PATENT DOCUMENTS

| | | | | |
|---|---|---|---|---|
| 8,227,964 | B2 * | 7/2012 | Choi et al. | 313/46 |
| 8,227,968 | B2 | 7/2012 | Kaandorp et al. | |
| 8,807,792 | B2 * | 8/2014 | Cho et al. | 362/247 |
| 8,840,269 | B2 * | 9/2014 | Kang | 362/241 |
| 2010/0002444 | A1 | 1/2010 | Konaka | |
| 2011/0242821 | A1 | 10/2011 | Pan | |
| 2012/0033423 | A1 * | 2/2012 | Kim et al. | 362/235 |
| 2012/0088189 | A1 * | 4/2012 | Miyagishima et al. | 430/280.1 |
| 2012/0243235 | A1 | 9/2012 | Gao | |
| 2013/0214666 | A1 * | 8/2013 | Leung et al. | 313/46 |

OTHER PUBLICATIONS

PCT, International Search Report and Written Opinion, PCT/US2014/035672 (Aug. 22, 2014).

* cited by examiner

*Primary Examiner* — Peggy Neils
(74) *Attorney, Agent, or Firm* — Thompson Hine LLP

(57) ABSTRACT

An LED lamp includes a heat dissipating base. The LED lamp further includes an LED assembly, including a plurality if LEDs. The LED assembly is in thermal communication with the heat dissipating base. The LED lamp further includes a bulb disposed over the LED assembly and coupled to the heat dissipating base. The LED lamp further includes a reflective insert disposed inside the bulb and configured to reflect a portion of light generated by the LED assembly in a substantially downward direction.

12 Claims, 4 Drawing Sheets

LED LAMP WITH CONTROLLED DISTRIBUTION

FIELD OF DISCLOSURE

The present disclosure relates to the field of lamps. More particularly, the present disclosure relates to an LED lamp with controlled light distribution.

BACKGROUND

Incandescent light bulbs generate light when a filament wire is heated by a passing electric current. The filament wire is positioned in the center of a bulb and therefore the light generally radiates both in an upward direction towards the top of the bulb and in a downward direction towards the bottom of the bulb. Incandescent light bulbs are commonly used in a variety of applications. Incandescent light bulbs, however, may be less efficient and less effective than LED light bulbs, and are therefore commonly replaced with more efficient and more effective LED light bulbs.

FIG. 1A illustrates a perspective view of example known LED lamp 100. FIG. 1B illustrates a partial perspective view of the example known LED lamp 100 of FIG. 1A. LED lamp 100 has an LED assembly 102 positioned on top of a base 106 and is covered by a bulb 108. LED assembly 102 includes LEDs 104 for generating light. However, because LED assembly 102 is positioned directly on top of base 106, at the bottom of bulb 108, light generated by LEDs 104 may radiate in a generally upward direction, toward the top of bulb 108.

SUMMARY OF THE DISCLOSURE

An LED lamp includes a heat dissipating base. The LED lamp further includes an LED assembly, including a plurality if LEDs. The LED assembly is in thermal communication with the heat dissipating base. The LED lamp further includes a bulb disposed over the LED assembly and coupled to the heat dissipating base. The LED lamp further includes a reflective insert disposed inside the bulb and configured to reflect a portion of light generated by the LED assembly in a substantially downward direction.

BRIEF DESCRIPTION OF THE DRAWINGS

In the accompanying drawings, structures are illustrated that, together with the detailed description provided below, describe exemplary aspects of the present teachings. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1A:
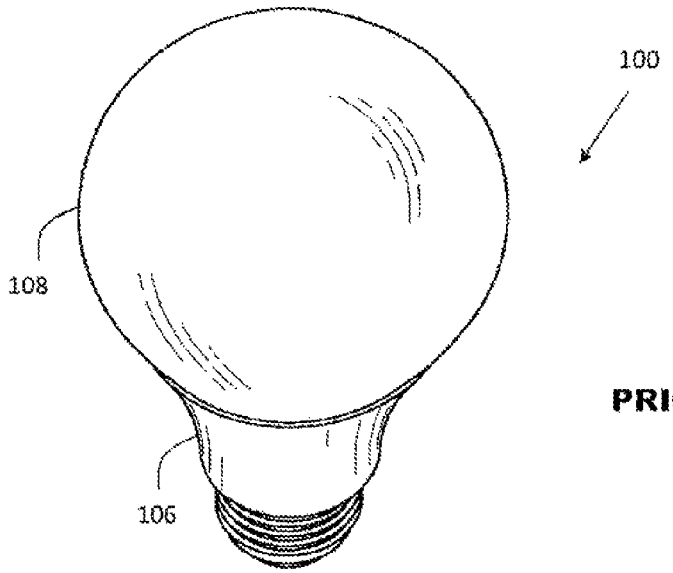
PRIOR ART FIG. 1A
FIG. 1A illustrates a perspective view of an example known LED lamp.
Figure 1B:
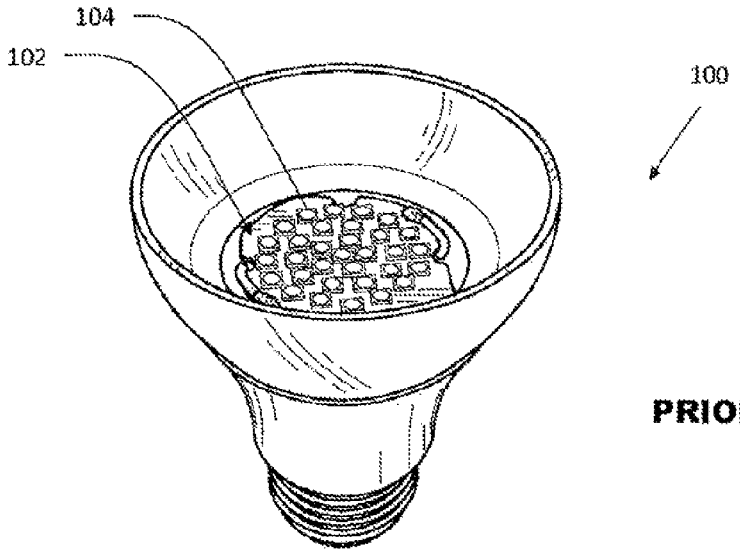
PRIOR ART FIG. 1B
FIG. 1B illustrates a partial perspective view of the example known LED lamp of FIG. 1.
Figure 2A:
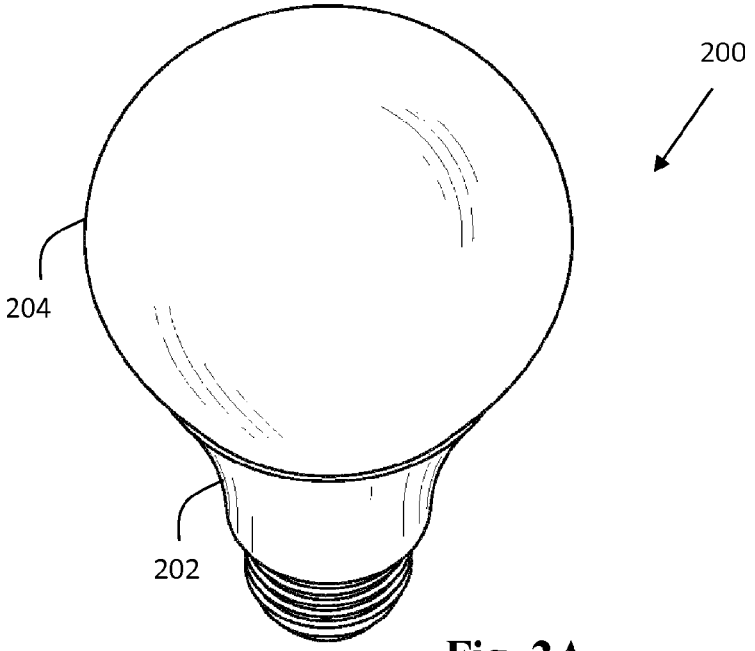
FIG. 2A illustrates a perspective view of an example LED lamp with controlled distribution.

FIG. 2A illustrates a perspective view of an example LED lamp with controlled distribution 200 (hereinafter referred to as LED lamp 200). LED lamp 200 includes a heat dissipating base 202 that supports an LED assembly (not shown) and sinks heat from the LED assembly. A bulb 204 is disposed over the LED assembly and is coupled to the heat dissipating base 202.

Heat dissipating base 202 may be constructed of thermoplastic, plastic, aluminum, or other suitable material capable of dissipating heat away from an LED assembly. Bulb 204 may be constructed of glass, plastic, or other suitable material capable of facilitating light dissipation. In one example, bulb 204 is transparent. In one example, bulb 204 is semi-transparent.

Figure 2B:
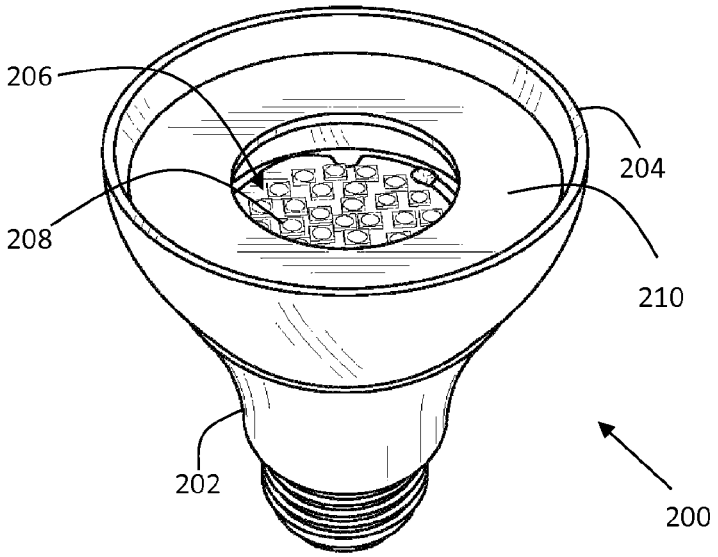
FIG. 2B illustrates a partial perspective view of an example LED lamp with controlled distribution.
Figure 2C:
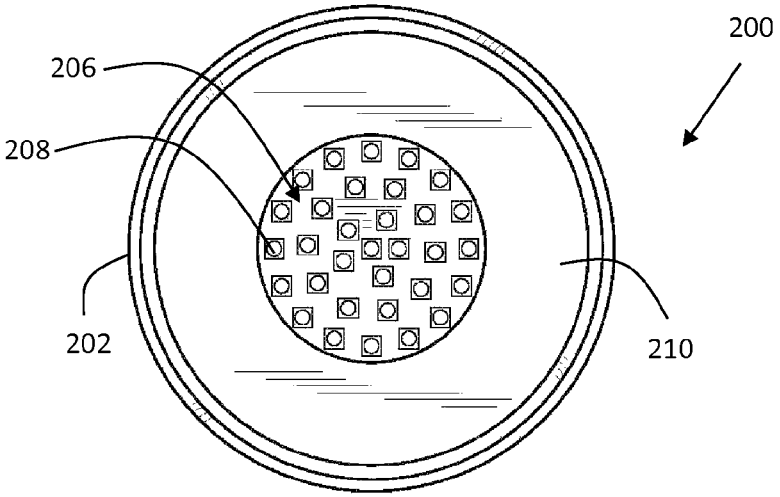
FIG. 2C illustrates a top view of the example LED lamp with controlled distribution of FIG. 2A.

FIG. 2B illustrates a partial perspective view of LED lamp 200 of FIG. 2A, the top portion of bulb 204 being removed for illustrative purpose. FIG. 2C illustrates a top view of the partial perspective view of LED lamp 200 of FIG. 2B. Lamp 200 includes an LED assembly 206 in thermal communication with heat dissipating base 202. LED assembly 206 includes LEDs 208 for generating light. LED assembly 206 may include any number of suitable LEDs 208. In addition, LEDs 208 may generate any suitable color of light.

LED lamp 200 includes a reflective insert 210 inside bulb 204 to control the distribution of generated light. Reflective insert 210 reflects a portion of the generated light in a downward direction so that lamp 200 may radiate light in a downward direction through a bottom portion of bulb 204. Reflective insert 210 also allows a remaining portion of generated light to pass through and to radiate in an upward direction. Thus, lamp 200 is configured to radiate light in an upward and a downward direction. By changing the position and configuration of reflective insert 210, the distribution of light can be controlled.

Figure 3A:
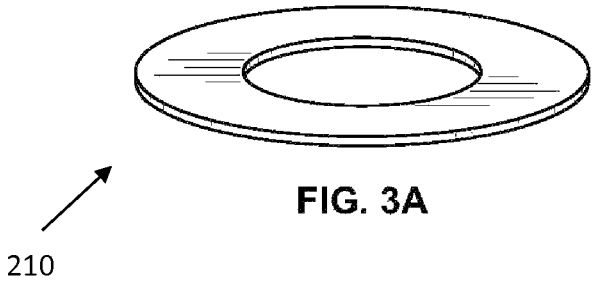
FIG. 3A illustrates a perspective view of an example reflective insert for controlling distribution of light.
Figure 3B:
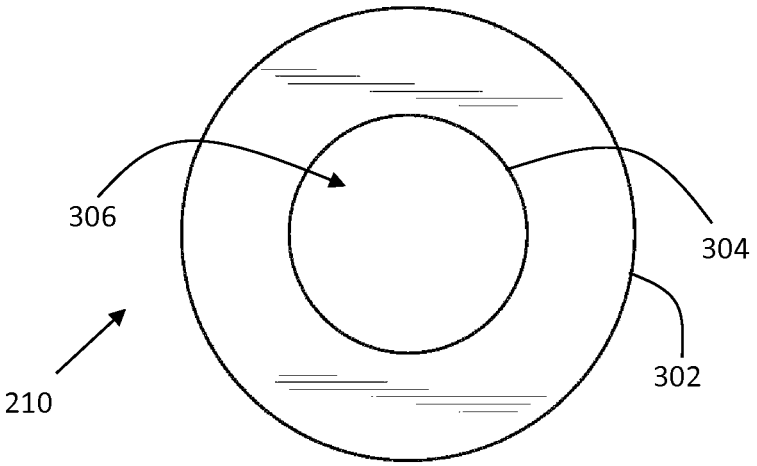
FIG. 3B illustrates a top view of the example reflective insert for controlling distribution of light of FIG. 3A.
Figure 3C:
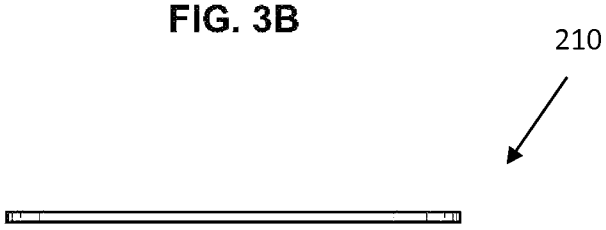
FIG. 3C illustrates a side view of the example reflective insert for controlling distribution of light of FIG. 3A.

FIG. 3A illustrates a perspective view of the example reflective insert 210 used in LED lamp 200. FIG. 3B illustrates a top view of the example reflective insert 210 of FIG. 3A. FIG. 3C illustrates a side view of the example reflective insert 210 of FIG. 3A. Reflective insert 210 is round, or circular shape. In one example, the circumference of the outer edge 302 of reflective insert 210 is substantially the same as the circumference of the inside of bulb 204, at the center of bulb 204. Accordingly, reflective insert 210 is positioned inside bulb 204, at the center of bulb 204, such that outer edge 302 of reflective insert 210 is flush against the inside of bulb 204.

In another example, the circumference of outer edge 302 of reflective insert 210 is smaller than the circumference of the inside of bulb 204, at the center of bulb 204. Thus, reflective insert 210 can be slid down into bulb 204 below the center of bulb 204, and positioned inside bulb 204 such that outer edge 302 of reflective insert 210 is flush against the inside of bulb 204 at a lower portion of bulb 204, closer to LED assembly 206. Thus, the circumference of outer edge 302 of reflective insert 210 determines reflective insert's 210 position within bulb 204. Adjusting the position of reflective insert 210 changes the way light is distributed through bulb 204. For example, the closer to LED assembly 206 that reflective insert 210 is positioned, the more light is reflected in a downward direction towards the bottom of bulb 204. Thus, by adjusting the position of reflective insert 210, distribution of light may be controlled.

Reflective insert 210 has an inner edge 304 that defines a circular opening 306. Opening 306 allows a portion of generated light to pass upward, through reflective insert 210, and radiate through the top of bulb 204. The circumference of inner edge 304, and in turn the size of opening 306, determines how much generated light is allowed to pass through and to radiate in an upward direction as compared to the amount of generated light that is reflected to radiate in a down direction. Thus, opening 306 may be adjusted in order to control distribution of generated light. For example, reflective insert 201 may configured with an opening 306 such that LED lamp 200 radiates 60% of generated light in an upward direction and 40% of generated light in a downward direction. Similarly, LED lamp 200 may be configured to radiate any suitable percentage of generated light in a downward direction.

As illustrated, reflective insert 210 is substantially flat. However, it should be appreciated that reflective insert 210 may have other suitable shapes for facilitating reflection of light in a generally downward direction. For example reflective insert 210 may be concave-shaped, con-shaped, and so on. It should also be appreciated that although a single opening 306 positioned in the center of reflective insert 210 is illustrated, reflective insert 210 may comprise any suitable number of openings positioned in any suitable location for allowing generated light to pass through, in an upward direction, towards the top portion of lamp 204.

Reflective insert 210 may be constructed of white paper, white plastic, or other suitable material of suitable color capable of reflecting light. In one example, reflective insert 210 is coated with a reflective paint.

Reflective insert 210 is illustrated as being positioned in a parallel position, relative to LED assembly 206. However, it should be understood that reflective insert 210 may be positioned alternatively in order to facilitate alternative distribution of generated light. For example, reflective insert 210 may be positioned at a forty five degree angle relative to LED assembly 206 (not shown). Accordingly, LED lamp 200 may be configured to radiate a portion of generated light in a generally upward direction and to radiate a remaining portion of generated light in a direction angled forty five degrees away from the downward direction.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of example aspects of the present disclosure thereof, and while the example aspects have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. An LED lamp comprising:

a heat dissipating base;

an LED assembly, comprising a plurality of LEDs, in thermal communication with the heat dissipating base;

a bulb disposed over the LED assembly and coupled to the heat dissipating base, the bulb defining an inner surface and an upper surface, wherein the upper surface is located along the inner surface of the bulb; and a reflective insert disposed inside the bulb and configured to reflect a portion of light generated by the LED assembly in a substantially downward direction, the reflective insert comprising:

an inner edge defining a circular opening including a circumference, wherein the circumference of the circular opening of the reflective insert allows a remaining portion of light generated by the LED assembly to pass through the reflective insert and radiate in a substantially upward direction towards the upper surface of the bulb; and an outermost edge that is flush against the inner surface of the bulb.

2. The LED lamp of claim 1, wherein the reflective insert is substantially flat.

3. The LED lamp of claim 1, wherein the reflective insert is disposed in a center of the bulb, and wherein an outer circumference of the reflective insert is substantially the same as an inner circumference of the center of the bulb.

4. The LED lamp of claim 1, wherein the reflective insert comprises paper.

5. The LED lamp of claim 1, wherein the reflective insert comprises plastic.

6. The LED lamp of claim 1, wherein the reflective insert comprises a reflective coating.

7. The LED lamp of claim 1, wherein the reflective insert is disposed inside the bulb, substantially parallel to the LED assembly.

8. The LED lamp of claim 1, wherein the bulb is transparent.

9. The LED lamp of claim 1, wherein the outermost edge of the reflective insert includes an outer circumference that corresponds with the inner surface of the bulb.

10. The LED lamp of claim 9, wherein the outer circumference of the reflective insert determines a position at which the reflective insert is located within the bulb.

11. The LED lamp of claim 1, wherein the circumference of the circular opening of the reflective insert is sized to allow about 60% of the light generated by the LED assembly to pass through the insert and radiate in the substantially upward direction towards the upper surface of the bulb.

12. The LED lamp of claim 1, wherein the circumference of the circular opening of the reflective insert is determinative of how much of the light generated by the LED assembly is allowed to pass through the reflective insert and radiate in the substantially upward direction.

* * * * *